US011510831B2

(12) United States Patent
Mavhungu et al.

(10) Patent No.: US 11,510,831 B2
(45) Date of Patent: Nov. 29, 2022

(54) SEAT ARRANGEMENT FOR A WHEELCHAIR AND A WHEELCHAIR INCLUDING SUCH A SEAT ARRANGEMENT

(71) Applicant: Portia Refilwe Mavhungu, Centurion (ZA)

(72) Inventors: Portia Refilwe Mavhungu, Centurion (ZA); Darushna Chellan, Centurion (ZA)

(73) Assignee: Portia Refilwe Mavhungu, Centurion (ZA)

( * ) Notice: Subject to any disclaimer, the term of this patent is extended or adjusted under 35 U.S.C. 154(b) by 387 days.

(21) Appl. No.: 16/499,090

(22) PCT Filed: Mar. 29, 2018

(86) PCT No.: PCT/IB2018/052165
§ 371 (c)(1),
(2) Date: Sep. 27, 2019

(87) PCT Pub. No.: WO2018/178912
PCT Pub. Date: Oct. 4, 2018

(65) Prior Publication Data

US 2021/0085542 A1 Mar. 25, 2021

(30) Foreign Application Priority Data

Mar. 31, 2017 (ZA) ..... 2017/02260

(51) Int. Cl.
*A61G 5/10* (2006.01)

(52) U.S. Cl.
CPC ..... *A61G 5/1002* (2013.01); *A61G 5/1091* (2016.11); *A61G 2203/70* (2013.01)

(58) Field of Classification Search
CPC ..... A61G 5/1002; A61G 5/1091; A61G 2203/70; A61G 7/02; A61G 9/00; A61G 9/003
See application file for complete search history.

(56) References Cited

U.S. PATENT DOCUMENTS 4,229,039 A * 10/1980 Day ..... A61G 5/1002 297/232
4,266,305 A * 5/1981 Kavaloski ..... A61G 5/1002 297/353

(Continued)

FOREIGN PATENT DOCUMENTS

CN 107928909 A * 4/2018 ..... A61G 7/02
CN 112237520 A * 1/2021

(Continued)

OTHER PUBLICATIONS

International Search Report for PCT/IB2018/052165 dated Jul. 9, 2018.

*Primary Examiner* — Jacob B Meyer
(74) *Attorney, Agent, or Firm* — Foley Hoag LLP

(57) ABSTRACT

A seat arrangement (10) for a wheelchair, as well as a wheelchair (40) incorporating such a seat arrangement (10), are disclosed. The arrangement includes a base, a connecting member and a supporting member. The base forms part of or is mounted to a seat of the wheelchair (40). The connecting member is slidably mounted to the base and displaceable relative to the base between a retracted position and an extended position. The supporting member is pivotably connected to the connecting member and shaped substantially so as to mate with the seat opening (22). The supporting being member is pivotable between an open position and a closed position. When the connecting member is in the retracted position and the supporting member is in the closed position, the supporting member mates with the seat opening (Continued)

(22) to define a sitting surface, and when the supporting member is in the open position, a seat opening (22) is exposed.

16 Claims, 8 Drawing Sheets

(56) References Cited

U.S. PATENT DOCUMENTS

| | | | | |
|---|---|---|---|---|
| 4,343,482 | A * | 8/1982 | Wegner | A61G 5/1002 280/42 |
| 4,949,408 | A * | 8/1990 | Trkla | A61G 5/006 297/DIG. 4 |
| 6,547,265 | B1 * | 4/2003 | Enge | A61G 5/1002 135/66 |
| 6,733,024 | B1 * | 5/2004 | Savegnago | A61G 5/1002 280/250.1 |
| 7,793,364 | B1 * | 9/2010 | Johnson | A61G 5/1002 4/480 |
| 8,171,583 | B1 * | 5/2012 | Hooker | A61G 7/02 5/604 |
| 8,510,881 | B1 * | 8/2013 | Lee | A61G 7/02 5/604 |
| 9,510,984 | B1 * | 12/2016 | MacKenzie | A47K 13/00 |
| 9,572,733 | B1 * | 2/2017 | Lai | A61G 5/08 |
| 10,939,785 | B2 * | 3/2021 | Hart | A61G 7/1098 |
| 2004/0045083 | A1 * | 3/2004 | Oetting | A61G 5/1002 4/480 |
| 2004/0227331 | A1 * | 11/2004 | Chen | A61G 5/1002 280/650 |
| 2010/0301639 | A1 * | 12/2010 | McPheeters | A61G 9/003 297/118 |
| 2011/0277230 | A1 * | 11/2011 | Williams | A61G 5/1002 4/480 |
| 2014/0042727 | A1 * | 2/2014 | Musham | A61G 5/107 280/304.1 |
| 2017/0333272 | A1 * | 11/2017 | Foster | A61G 7/02 |
| 2018/0271335 | A1 * | 9/2018 | Hart | A61G 5/1075 |
| 2019/0350411 | A1 * | 11/2019 | Hart | A61G 5/1067 |
| 2021/0085542 | A1 * | 3/2021 | Mavhungu | A61G 5/1091 |
| 2021/0275372 | A1 * | 9/2021 | Sonoda | A61G 5/1045 |

FOREIGN PATENT DOCUMENTS

| | | | | |
|---|---|---|---|---|
| KR | 20110008684 | U * | 9/2011 | |
| KR | 101627968 | B1 * | 6/2016 | A61G 9/00 |
| KR | 20180118301 | A * | 10/2018 | |
| KR | 20180118303 | A * | 10/2018 | |
| TW | 590768 | B * | 6/2004 | |
| WO | WO-8501864 | A1 * | 5/1985 | A61G 5/1002 |
| WO | WO-8501866 | A1 * | 5/1985 | A61G 5/1002 |
| WO | WO-9729726 | A1 * | 8/1997 | A61G 7/16 |
| WO | WO-2005011553 | A2 * | 2/2005 | A61G 5/023 |
| WO | WO-2011013068 | A2 * | 2/2011 | A61G 5/00 |
| WO | WO-2018031034 | A1 * | 2/2018 | A61G 9/003 |
| WO | WO-2018178912 | A1 * | 10/2018 | A61G 5/1002 |
| WO | WO-2020016882 | A1 * | 1/2020 | A61G 5/1002 |

* cited by examiner

SEAT ARRANGEMENT FOR A WHEELCHAIR AND A WHEELCHAIR INCLUDING SUCH A SEAT ARRANGEMENT

FIELD OF THE INVENTION

This invention relates, generally, to wheelchairs that incorporate toilet facilities. More particularly, the invention relates to a seat arrangement for a wheelchair, which permits the wheelchair to function as a toilet facility. The invention also relates to a wheelchair including such a seat arrangement and to a method of retrofitting a wheelchair.

BACKGROUND TO THE INVENTION

People who are confined to wheelchairs (hereinafter referred to as "wheelchair users" or simply "users") face challenges on a daily basis. For many wheelchair users, one of these challenges is the task of accessing and/or using a toilet facility.

The Inventors are aware of portable toilet units that have been developed to simplify the task of accessing a toilet facility by obviating the need for a wheelchair user to travel to a conventional toilet facility (i.e. a bathroom). However, such portable toilet units may still be difficult or challenging to use, as a wheelchair user is required to travel from his or her bed, chair, or wheelchair to the portable toilet unit in order to use it. The user may thus in many cases require the assistance of another person, e.g. a caregiver or family member, in order to use a typical portable toilet unit.

The Inventors are further aware of wheelchairs incorporating toilet facilities. A wheelchair of this type typically includes a seat provided with an opening through which waste matter can pass, in use. A waste receiving container, such as a bucket, can be positioned below the seat for receiving the waste matter. These wheelchairs thus provide a "mobile" toilet and enable a user to discharge bodily waste while seated on his or her wheelchair, thereby obviating the need for the user to travel to a conventional toilet facility or to a portable toilet unit.

While wheelchairs of the type described above (i.e. those providing "mobile" toilets) have proven to be beneficial to at least some wheelchair users, the Inventors have found that such wheelchairs may still be difficult to use without assistance. In particular, it may be difficult for a user to position, attach and/or remove the waste receiving container from below the seat, or to remove waste from the waste receiving container, without being assisted by another person.

There thus exists a need for a wheelchair incorporating a toilet facility that permits a wheelchair user to make use of the toilet facility with a greater degree of independence.

The Inventors have also identified a need for a device or arrangement that can be incorporated into a standard wheelchair to permit it to function as a toilet, without requiring significant alterations to the structure of the standard wheelchair.

The present invention aims to address the needs identified above, at least to some extent.

SUMMARY OF THE INVENTION

According to one aspect of the invention, there is provided a seat arrangement for a wheelchair, the seat arrangement including:

a base which forms part of, or which is fixedly mounted or fixedly mountable, to a seat of the wheelchair, the seat being provided with or defining a seat opening;

a connecting member which is slidably mounted or slidably mountable to the base, the connecting member being displaceable relative to the base between a retracted position and an extended position; and a supporting member which is pivotably connected or pivotably connectable to the connecting member, the supporting member being shaped and dimensioned substantially so as to mate with the seat opening, and the supporting being member further being pivotable between an open position and a closed position, wherein the connecting member and the supporting member are configured such that, with the connecting member operatively mounted to the base and the supporting member connected to the connecting member, when the connecting member is in the retracted position and the supporting member is in the closed position, the supporting member substantially mates with the seat opening such that the seat and the supporting member together define a sitting surface substantially concealing the seat opening, and when the supporting member is in the open position, the seat opening is at least partially exposed, thereby operatively permitting waste matter to pass through the seat opening.

In some embodiments, the seat arrangement includes the seat. Alternatively, the seat arrangement does not include the seat and the seat arrangement is configured to be fitted to the seat by mounting at least the base to the seat.

The seat opening may extend through an operative front region and into a central region of the seat. The seat opening may be generally rectangular or generally U-shaped in top view. The supporting member may also be generally rectangular or generally U-shaped in top view and may have a thickness similar to a thickness of the seat. The seat and the supporting member may include cushioning, e.g. foam material.

The supporting member may include a cushion. The supporting member may include a flat first end connected or connectable to the connecting member and a rounded free end.

The supporting member and/or the connecting member may be provided with a handle or strap to facilitate sliding displacement of the supporting member and the connecting member relative to the base. The handle or strap may be located such that it protrudes past a front of the seat when the connecting member is in the retracted position.

The supporting member may be complementally shaped to the seat such that, in use, when the supporting member is in the closed position and the connecting member is in the retracted position, the supporting member fits snugly into the seat opening.

The base may include a pair of mounting brackets, or rails, mounted or mountable to a bottom of the seat. The mounting brackets or rails may be spaced apart, extend substantially parallel to each other, located on opposite sides of the seat opening.

The connecting member may include or define a pair of elongate sliding elements. The connecting member may be a slidable frame which includes the pair of sliding elements. Each sliding element may be slidingly received by a corresponding one of the mounting brackets. The sliding elements may be mounted to inner sides of the mounting brackets. Relative sliding motion between the connecting member and the base may be provided and/or facilitated by a ball bearing arrangement. The connecting member may thus be connected to the mounting brackets via a pair of ball bearing runners configured to cooperate with the pair of mounting brackets and the connecting member.

The mounting brackets and sliding elements may extend generally parallel to the sitting surface or a sitting plane defined by the seat. Accordingly, the connecting member may be slid along the sitting plane relative to the base.

The seat arrangement may include a waste frame. The waste frame may form part of, be connected to or fitted to the connecting member. The waste frame may be operatively positioned removably on top of the connecting member. In some embodiments, the waste frame connects the sliding elements to each other. In such cases, each side of the waste frame may be connected to a respective sliding element. In other embodiments, the connecting member is in the form of a frame and the waste frame may be connected or fitted onto or over the connecting member.

The waste frame may define a central opening, or waste opening, which is configured to be at least partially aligned with the seat opening when the connecting member is in the retracted position.

It will be understood that the waste frame may form part of the connecting member and the waste opening may thus be defined by the connecting member, e.g. an opening in a sliding frame.

The connecting member may be configured such that, when the supporting member is in the open position, the waste frame is exposed. The central opening may have a rectangular or oblong shape.

The connecting member may be configured such that, when in the retracted position, the sliding elements and the waste frame are positioned operatively directly below the seat.

The supporting member may be pivotably connected to an operative front portion of the connecting member, e.g. to a front region of the waste frame. The supporting member may be connected to the connecting member by way of a hinge or hinge arrangement at one end of the supporting member.

The supporting member may be configured such that, when in the closed position, a length of the supporting member is generally parallel to or disposed in the sitting plane. A top surface of the supporting member may be substantially flush with a top surface of the seat when in the closed position, thereby defining the sitting surface. When in the open position, the length of the supporting member may extend at an obtuse angle relative to the sitting plane. A free end of the supporting member may thus face away from the seat when in the open position.

The connecting member may be configured such that, when in the extended position, the supporting element is at least partially clear of the seat. In some embodiments, the supporting element is completely clear of the seat when the connecting member is in the extended position.

The waste frame may be configured for the attachment of a waste receiving container thereto. The waste receiving container may be a disposable waste bag. The waste receiving container may operatively be attached to the waste frame such that a body of the container is positioned below the waste frame and an opening of the container faces the central opening, thereby ensuring that waste matter discharged through the seat opening and/or the central opening operatively falls into the container.

The waste frame may provide attachment formations by which the waste receiving container can be removably attached to the waste frame.

According to another aspect of the invention, there is provided a wheelchair including a seat arrangement substantially as described above.

According to a further aspect of the invention, there is provided a method of retrofitting a wheelchair, the method including the steps of:

providing a wheelchair;

providing a seat arrangement substantially as described above; and mounting the base of the seat arrangement to a seat of the wheelchair, thereby providing the wheelchair with a toilet facility.

The method may include the step of providing a seat substantially as described above if the seat arrangement does not include the seat.

According to a further aspect of the invention, there is provided a method of retrofitting a wheelchair, the method including the steps of:

providing a wheelchair; and replacing a seat of the wheelchair with a seat arrangement substantially as described above, wherein the seat arrangement includes a seat.

The method may further include the step of providing the seat with a seat opening as described above, i.e. an opening which is shaped and dimensioned substantially to mate with the supporting member of the seat arrangement when the supporting member is in the closed position and the connecting member of the seat arrangement is in the retracted position.

According to another aspect of the invention, there is provided a seat arrangement for a wheelchair, the seat arrangement including a seat and a complemental supporting member, wherein the supporting member is slidably and pivotably displaceable relative to the seat between a closed position, in which the supporting member substantially mates with the seat in complemental fashion to define a sitting surface, and an open position, in which a seat opening is defined or exposed between the seat and the supporting member, thereby operatively to provide a toilet facility for a wheelchair user.

BRIEF DESCRIPTION OF THE DRAWINGS

The invention will now be further described, by way of example, with reference to the accompanying drawings.

In the drawings.

DETAILED DESCRIPTION WITH REFERENCE TO THE DRAWINGS

Figure 1:
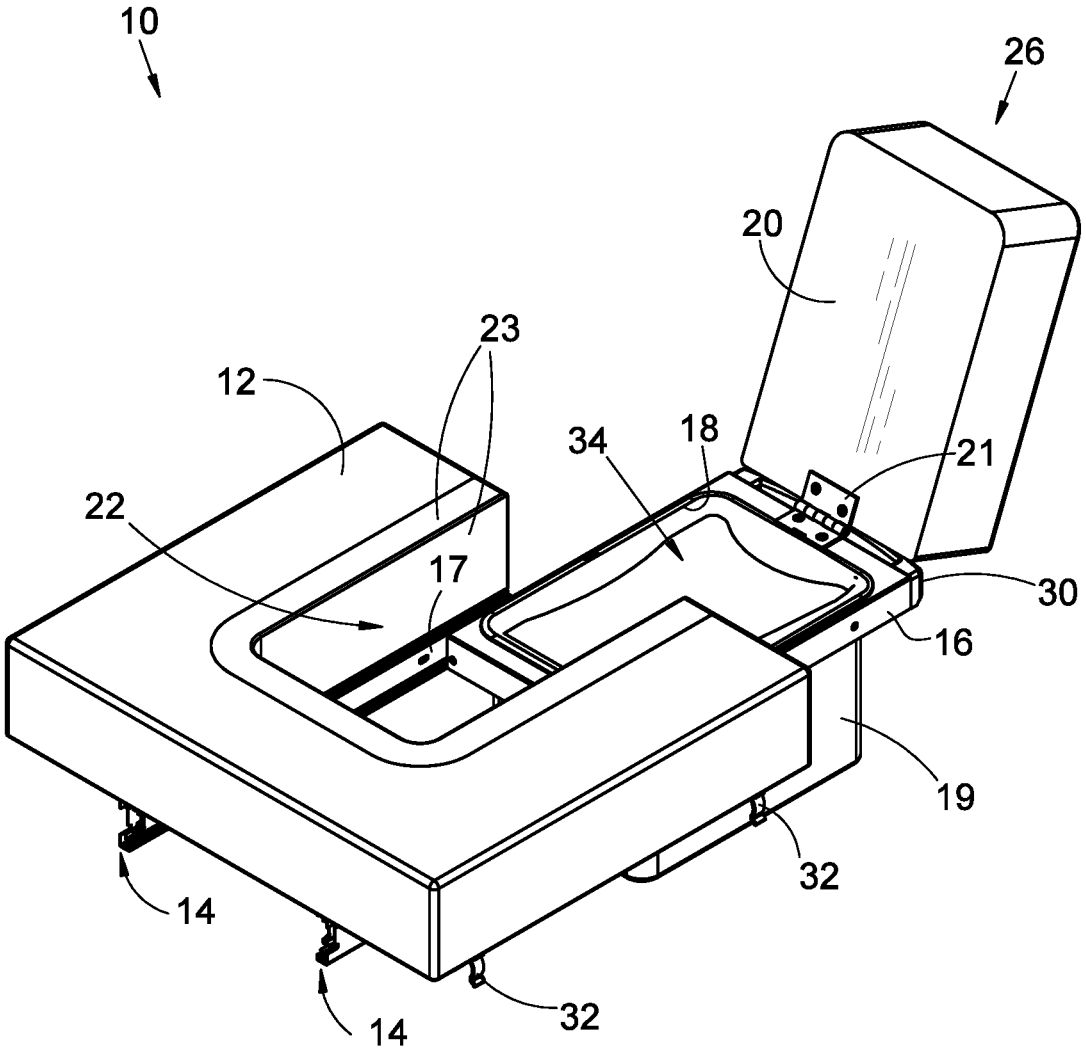
FIG. 1 shows a three-dimensional view of an embodiment of a seat arrangement for a wheelchair according to the invention, wherein a supporting member of the seat arrangement is in an open position and a connecting member of the seat arrangement is in a substantially extended position.
Figure 2:
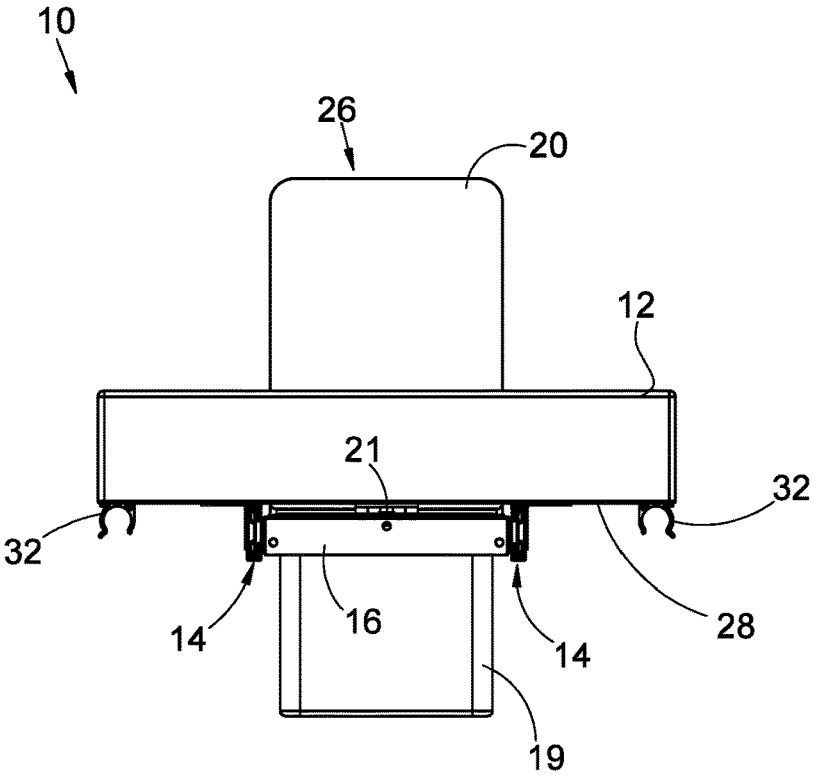
FIG. 2 shows a rear view of the seat arrangement of FIG. 1, with the supporting member in the open position and the connecting member in the substantially extended position.

The following description of the invention is provided as an enabling teaching of the invention. Those skilled in the relevant art will recognise that many changes can be made to the embodiment(s) described, while still attaining the beneficial results of the present invention. It will also be apparent that some of the desired benefits of the present invention can be attained by selecting some of the features of the present invention without utilising other features. Accordingly, those skilled in the art will recognise that modifications and adaptations to the present invention are possible and can even be desirable in certain circumstances, and are a part of the present invention. Thus, the following description is provided as illustrative of the principles of the present invention and not a limitation thereof.

An embodiment of a seat arrangement according to the invention is generally indicated by reference numeral 10 in FIGS. 1 to 10. The seat arrangement 10 is configured to be fitted to a wheelchair to provide the wheelchair with a toilet function or facility, which may obviate the need for a wheelchair user to get out of the wheelchair in order to use such facility.

The seat arrangement 10 includes a seat 12 and a base defined by a pair of elongate mounting brackets 14 mounted to a bottom of the seat 12. The seat arrangement 10 further includes a connecting member in the form of a rectangular sliding frame 16. The sliding frame 16 is slidably connected to the mounting brackets 14 by way of a pair of elongate ball bearing runners 17 fitted to the mounting brackets 14.

A thin waste frame 18, which is rectangular with rounded corners, is removably fitted to the top of the sliding frame 16. A disposable waste bag 19 is in turn fitted to the waste frame 18 such that it hangs downwardly from the waste frame 18 and an opening of the waste bag 19 faces operatively upwardly. The features and use of the waste frame 18 and bag 19 are described in greater detail with reference to FIGS. 9 and 10.

In addition to the above, the seat arrangement 10 includes a supporting member in the form of a cushion 20 which is pivotably connected to an operative front region of the sliding frame 16 by way of a hinge 21 that is centrally located along a width of the front region of the sliding frame 16.

Figure 4:
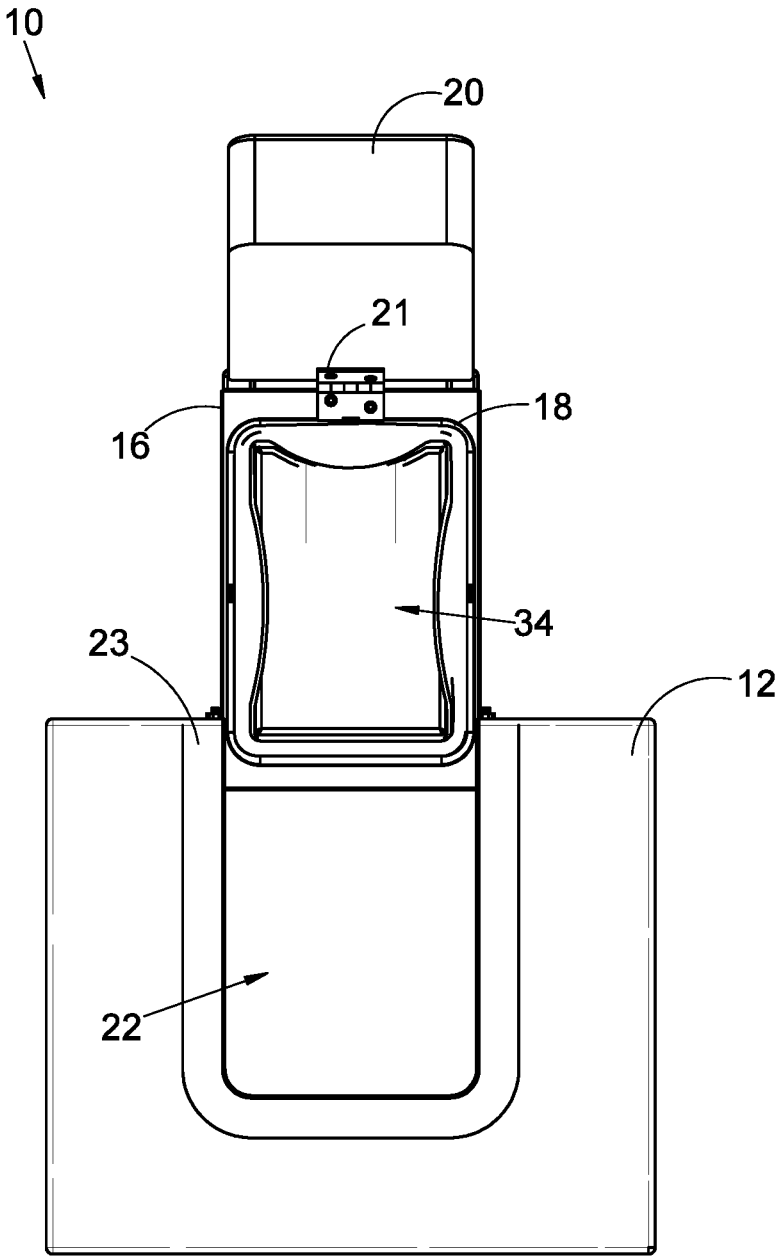
FIG. 4 shows a top view of the seat arrangement of FIG. 1, with the supporting member in the open position and the connecting member in the substantially extended position.

The seat 12 is generally rectangular in top view and is provided with a seat opening 22 extending through the operative front region and into a central region of the seat 12. The seat opening 22 is generally rectangular in top view, with one pair of rounded corner regions in a central region of the seat 12, as illustrated in FIG. 4.

Figure 5:
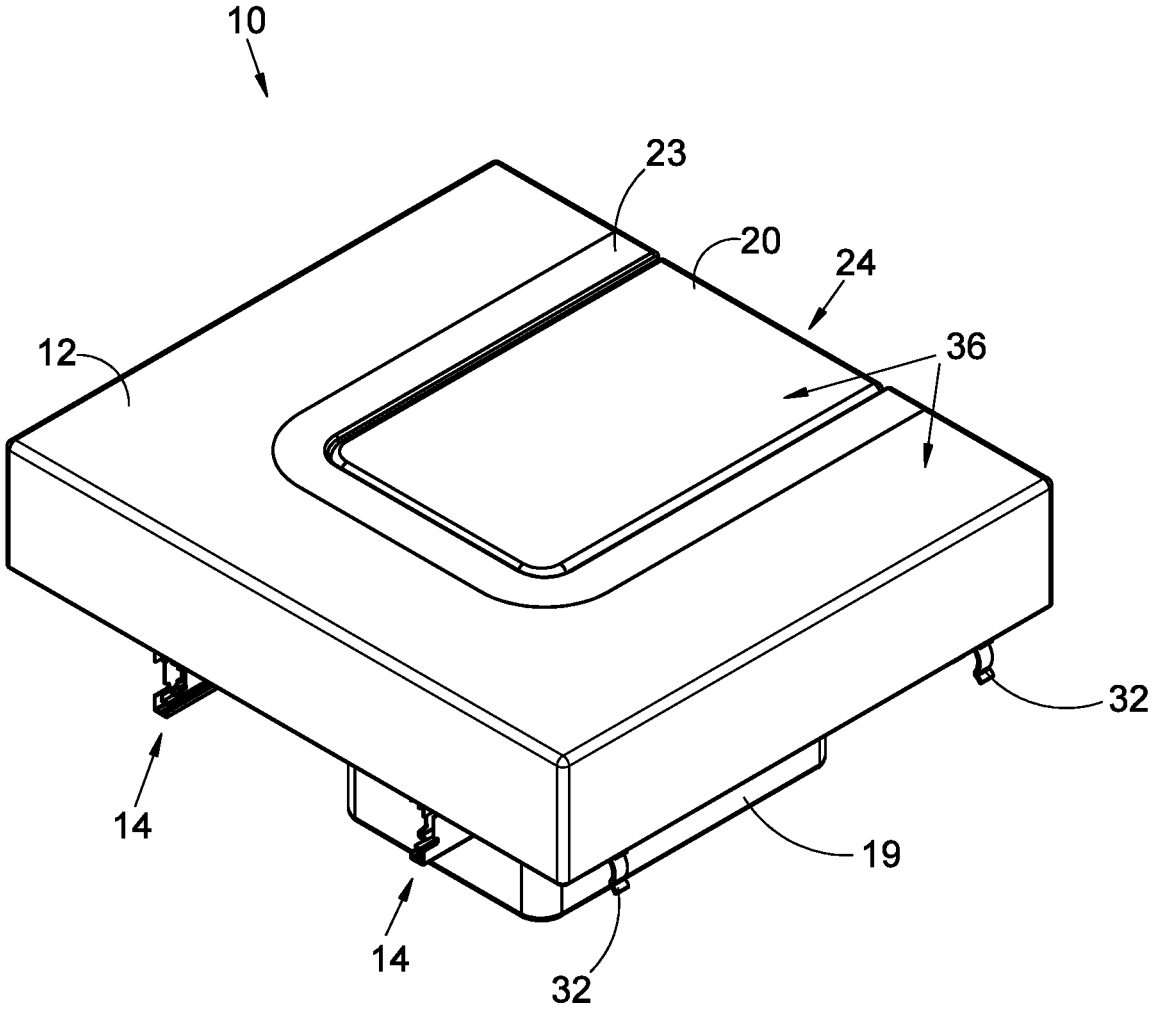
FIG. 5 shows a three-dimensional view of the seat arrangement of FIG. 1, wherein the supporting member is in a closed position and the connecting member is in a retracted position.
Figure 6:
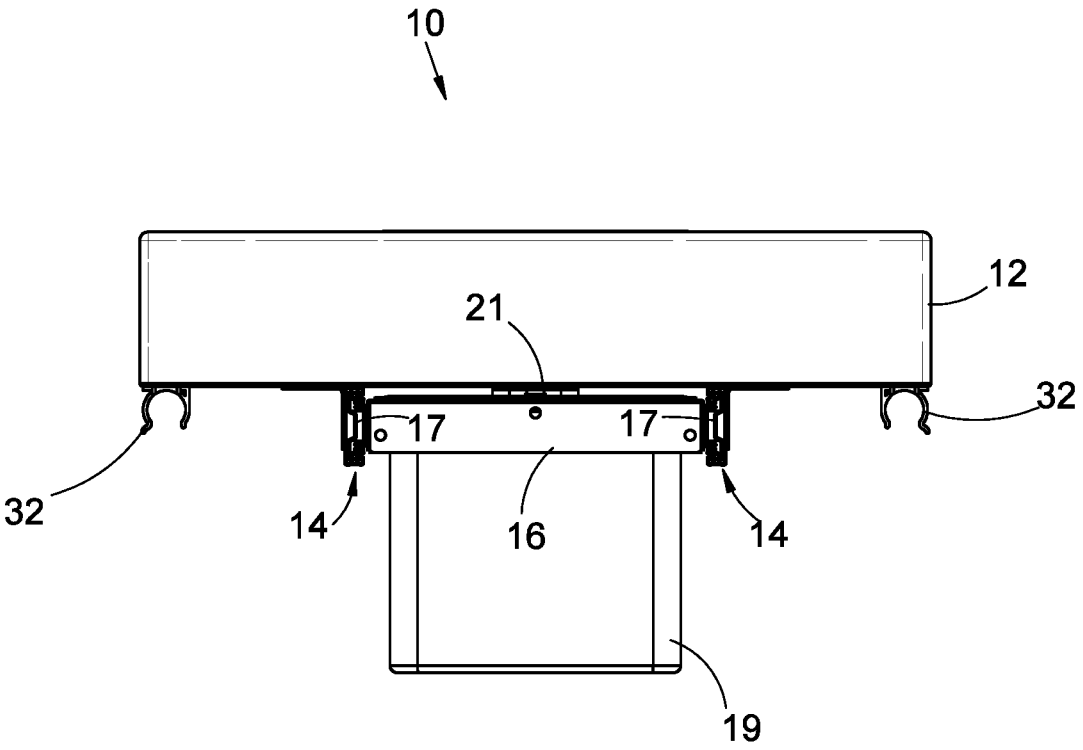
FIG. 6 shows a rear view of the seat arrangement of FIG. 1, with the supporting member in the closed position and the connecting member in the retracted position.
Figure 7:
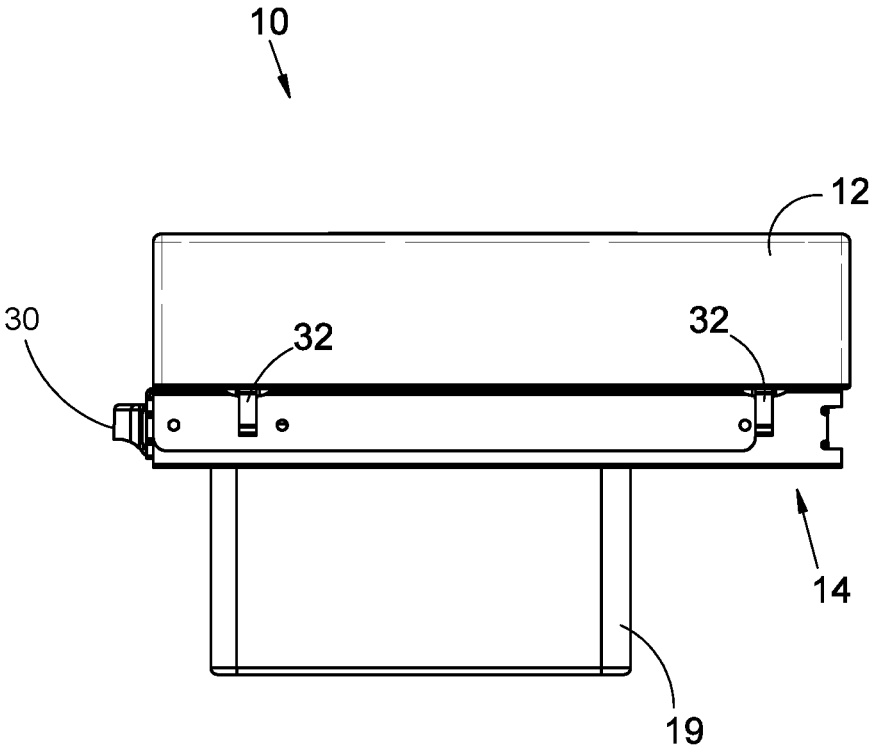
FIG. 7 shows a side view of the seat arrangement of FIG. 1, with the supporting member in the closed position and the connecting member in the retracted position.
Figure 8:
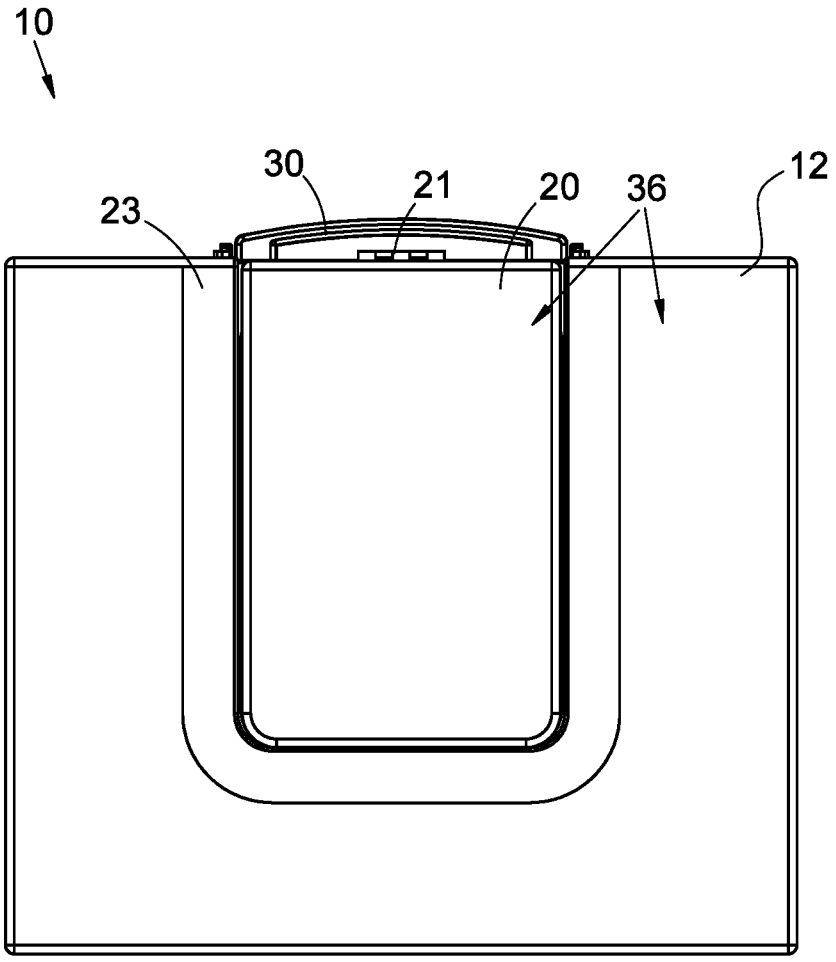
FIG. 8 shows a top view of the seat arrangement of FIG. 1, with the supporting member in the closed position and the connecting member in the retracted position.

The cushion 20 is complementally shaped to the seat opening 22, as is best shown in FIGS. 5 and 8. The cushion 20 is thus substantially rectangularly cuboidal, and is also substantially rectangular in top view, thereby enabling it to fit snugly into the seat opening 22, as will be described below. The cushion 20 includes a flat first end 24, by which it is connected to the waste frame 18, and a free end 26 with rounded corner regions that are configured to mate with the pair of rounded corner regions of the seat opening 22.

In this embodiment, the cushion 20 and the seat 12 are of equal thickness and are manufactured predominantly from layers of foam material. The foam material is covered by canvas material to provide a relatively durable outer layer for the cushion 20 and the seat 12. The surfaces of the seat 12 which define the seat opening 22, as well as upper surrounding edges of the seat 12, are covered with PVC (polyvinyl chloride) to provide a durable, substantially water and stain resistant region 23. The Inventors have found that this region 23 is relatively easy to clean relative to the canvas material covering the rest of the seat 12 and cushion 20.

The mounting brackets 14 are fixedly mounted to a rigid (in this case wooden) bottom surface 28 of the seat 12. The mounting brackets 14 are spaced apart and are positioned in such a manner that they extend parallel to each other on opposite sides of the seat opening 22. The bottom surface 28 is further provided with a pair of substantially U-shaped wheelchair mounting clips 32 on each side thereof, for mounting the seat arrangement 10 onto horizontal, tubular frame members of a wheelchair, in use (see FIGS. 9 and 10).

The sliding frame 16 defines a pair of elongate side elements, or sliding elements, respectively mounted to inner sides of the mounting brackets 14, by way of the runners 17, such that the sliding frame 16 can be displaced relative to the mounting brackets 14 in a sliding manner, in use, while remaining coupled to the mounting brackets 14.

Figure 3:
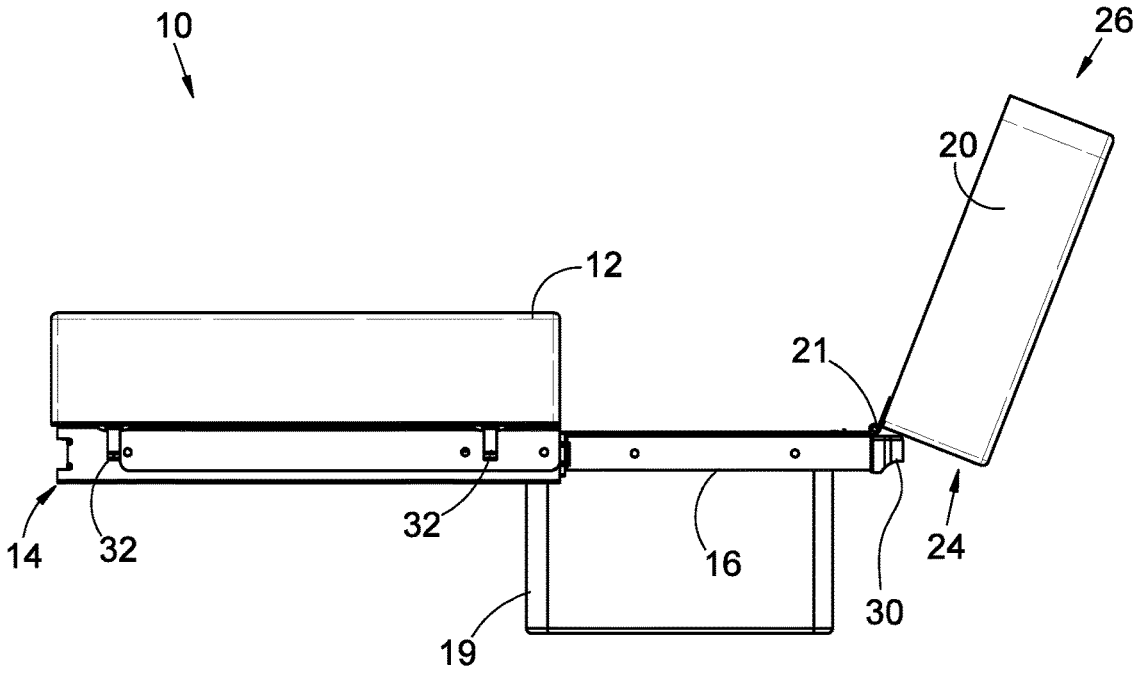
FIG. 3 shows a side view of the seat arrangement of FIG. 1, with the supporting member in the open position and the connecting member in the substantially extended position.

The mounting brackets 14 and the sliding frame 16 extend parallel to a sitting plane defined by the seat 12, as is clear from the side view shown in FIG. 3. Accordingly, the sliding frame 16 is slidably displaceable along the sitting plane relative to the mounting brackets 14 and the seat 12. The cushion 20, being attached to the sliding frame 16, is thus also slidably displaceable along the sitting plate relative to the mounting brackets 14 and the seat 12. The waste frame 18 operatively slides together with the sliding frame 16.

In this embodiment, the mounting brackets 14 are made from mild steel and the sliding frame 16 is made from stainless steel.

The sliding frame 16 and the waste frame 18 both include a rectangular central opening. The waste frame 18 is positioned on top of the sliding frame 16 in such a manner that these two central openings are aligned, together defining a waste opening 34 of the seat arrangement 10. The waste opening 34 is shaped and located such that, when the sliding frame 16 is positioned appropriately relative to the brackets 14, waste matter operatively passing through the seat opening 22 passes into the bag 19 via the waste opening 34.

The sliding frame 16 and the waste frame 18 are slidable between a retracted position and an extended position. The retracted position is shown in FIGS. 5 to 8, while FIGS. 1 to 4 illustrate a substantially extended position. In the retracted position, the sliding frame 16 and waste frame 18 are located directly below the seat 12 such that the waste opening 34 is in register with the seat opening 22, while the sliding frame 16 extends outwardly away from the seat 12 in the extended position. When the sliding frame 16 is extended, the cushion 20 can thus be located clear of the seat 12 (see FIGS. 1, 3 and 4). The Inventors have found that this may make it easier for a wheelchair user to operate the seat arrangement 10 in a substantially independent manner.

The operative front end of the sliding frame 16 is provided with a handle 30 which facilitates sliding of the sliding frame 16 from below the seat 12 in use. In the retracted position, the handle 30 protrudes slightly past the front of the seat 20 to make it easier to reach by a wheelchair user (see specifically FIG. 7).

As mentioned above, one of the ends 24 of the cushion 20 is pivotably connected to the waste frame 18 by way of the hinge 21. In this way, the cushion 20 can be pivoted between an open position and a closed position. The open position, in which the cushion 20 is essentially unfolded and a length of the cushion 20 extends at an obtuse angle relative to the sitting plane, is shown in FIGS. 1 to 4, while the closed position, in which the cushion 20 is essentially folded towards the seat 12 and the length of the cushion 20 extends parallel to or is disposed in the sitting plane, is shown in FIGS. 5 to 8.

When the cushion 20 is in the closed position and the sliding frame 16 and waste frame 18 are retracted, the cushion 20 mates with the seat opening 22, i.e. fits snugly into the seat opening 22. A top surface of the seat 12 and a top surface of the cushion 22 are flush and a sitting surface 36 is defined by these surfaces. The sitting surface 36 fully conceals or closes the seat opening 22 and also conceals the waste opening 34. This position is shown in FIGS. 5 to 8.

When the cushion 20 is in the open position, the seat opening 20 and the waste opening 34 are exposed. When the sliding frame 16 and waste frame 18 are retracted, the openings 20 and 34 are aligned. In FIGS. 1 to 4, the sliding frame 16 and waste frame 18 are extended and the openings 20 and 34 are therefore not in register.

Figure 9:
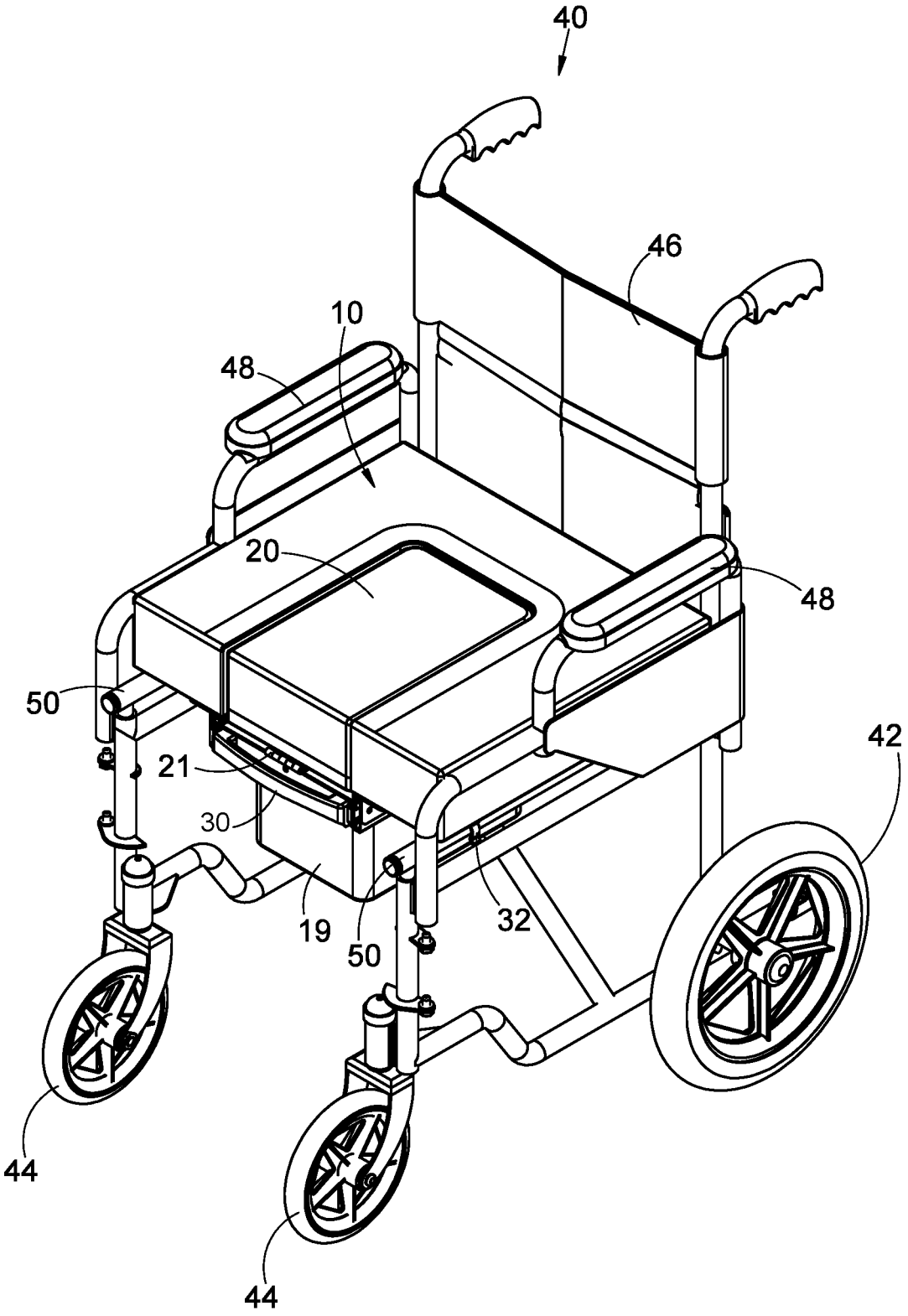
FIG. 9 shows a three-dimensional view of an embodiment of a wheelchair according to the invention, wherein the wheelchair includes the seat arrangement of FIG. 1, with the supporting member shown in the closed position and the connecting member in the retracted position.
Figure 10:
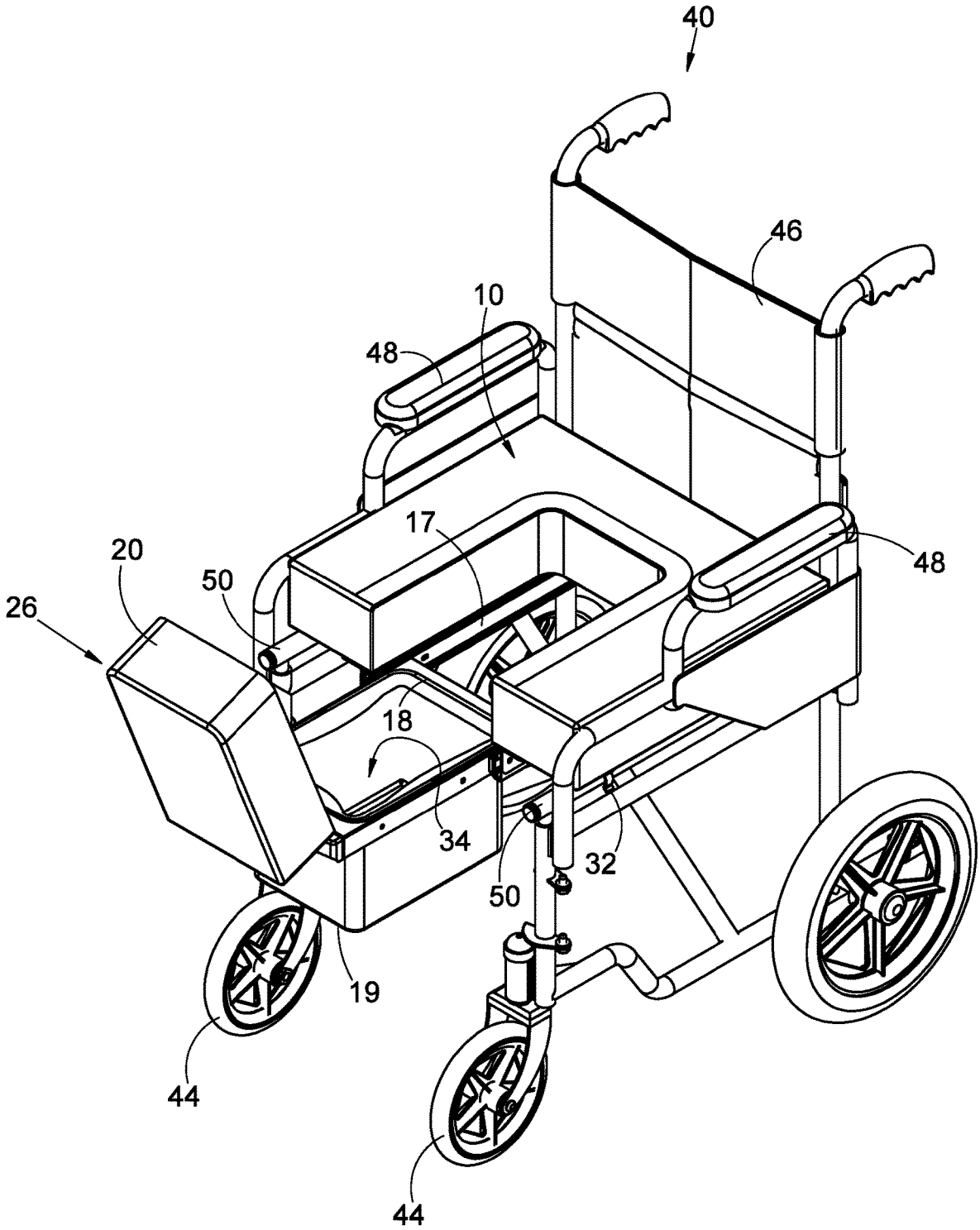
FIG. 10 shows another three-dimensional view of the wheelchair of FIG. 9, with the supporting member shown in the open position and the connecting member in the substantially extended position.

FIGS. 9 and 10 illustrate the seat arrangement 10 fitted to a wheelchair 40. The wheelchair 40 is a conventional manual wheelchair with two larger rear wheels 42, two smaller front wheels 44, a backrest 46 and a pair of armrests 48. A standard seat of the wheelchair 40 has been replaced by the seat arrangement 10 described with reference to FIGS. 1 to 8. The wheelchair 40 has thus been retrofitted to provide it with a toilet facility.

The clips 32 at the bottom of the seat arrangement 10 are clipped over horizontal, tubular frame members 50 of the wheelchair 40 (two clips 32 are clipped over each of the two frame members 50) to hold the seat arrangement 10 in position, and the seat arrangement 10 may be unclipped if this is desired.

In use, when the sliding frame 16 and waste frame 18 are retracted and the cushion 20 is closed, as shown in FIG. 9, the wheelchair 40 can be used in the normal way (i.e. for its conventional purpose). In other words, the seat 12 and the cushion 20 define a sitting surface for the wheelchair user to sit on while in the wheelchair and the seat opening 22 and waste opening 34 are substantially concealed.

To enable the use of the toilet facility with which the wheelchair 40 is equipped, the disposable waste bag 19 as shown in the drawings must be attached to the waste frame 18. The handle 30 may be used to slide the cushion 20 away from the seat 12. Then, the cushion 20 may be folded out to expose the waste frame 18. The bag 19 is attached to the waste frame 18 such that a body of the bag 19 depends from and is positioned below the waste frame 18, as best illustrated in FIG. 10. As explained above, the opening of the bag 19 coincides with the central opening 34.

In this particular embodiment, upper edges defining the bag's opening are essentially clamped between bottom edges of the waste frame 18 and upper edges of the sliding frame 16. Accordingly, the waste frame 18 acts as an "opening rim" to the bag 19. The Inventors have found that it may be advantageous to use a bag that consists of two layers, of which an inner layer is made of an absorbent material. Additionally, material such as cotton wool with absorbent gel may be located on the inside of the inner layer, i.e. in a waste receiving cavity defined by the inner layer.

It will be understood that, although not shown in the drawings, the waste frame 18 may include attachment formations by which a waste receiving container, such as the bag 19, can be removably attached to the waste frame 18.

When a wheelchair user wishes to discharge waste matter, the cushion 20 is pivoted from the closed position to the open position such that its free end 26 extends away from the seat 12. In this position, a length of the cushion 20 extends at an obtuse angle relative to the seat or the sitting plane define thereby. The sliding frame 16 may remain retracted such that the waste opening 34 and seat opening 22 are aligned, or the sliding frame 16 may be moved relatively away from the seat 12 (i.e. extended) up to a desired position, depending on the user's preference. Waste matter can then be discharged through the openings 22 and 34, which will be at least partially aligned with each other depending on the relative positions of the sliding frame 16 and the seat 12, and into the bag 19 below.

After making use of the toilet facility, the user may wish to access the waste frame 18 and the bag 19 by sliding the waste frame 18 out from underneath the seat 12. The waste frame 18 may be lifted up from the sliding frame 16 to remove the bag 19 and the bag 19 may be replaced by a fresh bag by again securing edges of the bag between the waste frame 18 and the sliding frame 16. Alternatively, one of the components of the bag 19 such as in inner layer may simply be removed and replaced while an outer layer of the bag 19 remains clamped in position.

It should be appreciated that the waste frame 18 and the sliding frame 16 may in other embodiments be provided by a single frame component, e.g. a sliding frame with attachment formations for removably attaching a waste container thereto.

The Inventors believe that the seat arrangement and wheelchair described herein provides numerous advantages.

The Inventors have found that a wheelchair user may be provided with a comfortable seat when the cushion 20 is closed and the sliding frame 16 is retracted, while the cushion 20 and sliding frame 16 can be relatively easily manipulated in order to use the built-in toilet functionality, thereby essentially providing a mobile toilet facility.

A wheelchair user may be able to operate the seat arrangement 10 in a largely independent manner. Specifically, the waste frame 18 may be accessed easily by sliding it out to an extended position in order to attach or remove a waste container and/or to remove waste matter from the container. The user may also convert the wheelchair 40 between various positions, such as those shown in FIGS. 9 and 10, respectively, without requiring assistance from another person.

Furthermore, the waste frame 18 may be used in various different positions relative to the seat 10, depending on the user's preference or requirements. As a result, a wheelchair fitted with the seat arrangement 20 may be capable of accommodating various different body types and/or physical capabilities.

The Inventors have also found that the seat arrangement 20 can be fitted to a standard wheelchair without requiring significant alternations. For example, the entire seat of the standard wheelchair may be replaced or a seat arrangement without a seat can be fitted to the seat of the standard wheelchair. In the latter case, the seat of the standard wheelchair may simply be modified such that it defines a seat opening as described herein.

Additionally, the seat arrangement can be relatively easily removed from a wheelchair if required, e.g. to fold and store it or to replace it with a conventional wheelchair seat if the wheelchair user does not wish to use the toilet facility provided by the seat arrangement.

The invention claimed is:

1. A seat arrangement for a wheelchair, the seat arrangement including:

a base which forms part of, or which is fixedly mounted or fixedly mountable, to a seat of the wheelchair, the seat being provided with or defining a seat opening;

a connecting member which is slidably mounted or slidably mountable to the base, the connecting member being displaceable relative to the base between a retracted position and an extended position; and a supporting member which is pivotably connected or pivotably connectable to the connecting member, the supporting member being shaped and dimensioned substantially so as to mate with the seat opening, and the supporting member further being pivotable between an open position and a closed position, wherein the connecting member and the supporting member are configured such that, with the connecting member operatively mounted to the base and the supporting member connected to the connecting member, when the connecting member is in the retracted position and the supporting member is in the closed position, the supporting member substantially mates with the seat opening such that the seat and the supporting member together define a sitting surface substantially concealing the seat opening, and when the supporting member is in the open position, the seat opening is at least partially exposed, thereby operatively permitting waste matter to pass through the seat opening, wherein the supporting member is pivotably connected to an operative front portion of the connecting member by way of a hinge or hinge arrangement and wherein the supporting member is configured such that, when in the open position, the length of the supporting member extends at an obtuse angle relative to the sitting plane, and a free end of the supporting member faces away from the seat.

2. The seat arrangement according to claim 1, wherein the supporting member and/or the connecting member is provided with a handle or strap to facilitate displacement of the supporting member and the connecting member relative to the base.

3. The seat arrangement according to claim 2, wherein the handle or strap is located such that it protrudes past a front of the seat when the connecting member is in the retracted position.

4. The seat arrangement according to claim 1, wherein the supporting member is complementally shaped to the seat such that, in use, when the supporting member is in the closed position and the connecting member is in the retracted position, the supporting member fits snugly into the seat opening.

5. The seat arrangement according to claim 1, wherein the base includes a pair of mounting brackets or a pair of rails mounted or mountable to a bottom of the seat.

6. The seat arrangement according to claim 5, wherein the mounting brackets or rails are spaced apart, extend substantially parallel to each other and are located on opposite sides of the seat opening, the connecting member including a pair of elongate sliding elements, and wherein each sliding element is configured to be slidingly received by a corresponding one of the mounting brackets or rails.

7. The seat arrangement according to claim 6, wherein relative sliding motion between the connecting member and the base is provided or facilitated by a ball bearing arrangement.

8. The seat arrangement according to claim 1, wherein the connecting member is configured operatively to be located below the seat when in the retracted position, the seat arrangement including a waste frame configured for attachment of a waste receiving container thereto.

9. The seat arrangement according to claim 8, wherein the waste frame forms part of, is connected to or is fitted to the connecting member, the waste frame defining a central opening, or waste opening, which is configured to be at least partially aligned with the seat opening when the connecting member is in the retracted position of and which is configured such that when the supporting member is in the open position, the waste frame is exposed.

10. The seat arrangement according to claim 9, wherein the waste receiving container is operatively attached to the waste frame such that a body of the container is positioned below the waste frame and an opening of the container faces the waste opening of the waste frame, thereby permitting waste matter discharged through the seat opening and the waste opening operatively to fall into the container.

11. The seat arrangement according to claim 1, wherein the supporting member is configured such that, when in the closed position, a length of the supporting member is generally parallel to or disposed in a sitting plane, and a top surface of the supporting member is substantially flush with a top surface of the seat, thereby defining the sitting surface.

12. The seat arrangement according to claim 1, which includes a seat to which the base is fixedly mounted.

13. A wheelchair which includes the seat arrangement according to claim 1.

14. A method of retrofitting a wheelchair, the method including the steps of:

providing a wheelchair;

providing the seat arrangement according to claim 1; and mounting the base of the seat arrangement to a seat of the wheelchair, thereby providing the wheelchair with a toilet facility.

15. The method according to claim 14, further including the step of providing the seat of the wheelchair with a seat opening which is shaped and dimensioned substantially to mate with the supporting member of the seat arrangement when the supporting member of the seat arrangement is in the closed position and the connecting member of the seat arrangement is in the retracted position.

16. A method of retrofitting a wheelchair, the method including the steps of:

providing a wheelchair; and replacing a seat of the wheelchair with the seat arrangement according to claim 12.

* * * * *